US012528661B2

(12) United States Patent
Arakane et al.

(10) Patent No.: US 12,528,661 B2
(45) Date of Patent: Jan. 20, 2026

(54) IMAGE FORMING APPARATUS

(71) Applicant: BROTHER KOGYO KABUSHIKI KAISHA, Nagoya (JP)

(72) Inventors: Satoru Arakane, Nagoya (JP); Masashi Ohhashi, Kasugai (JP); Koichi Tsugimura, Nagoya (JP); Haruka Azechi, Nagoya (JP); Yasuhiro Nakano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 193 days.

(21) Appl. No.: 18/350,078

(22) Filed: Jul. 11, 2023

(65) Prior Publication Data

US 2024/0109342 A1 Apr. 4, 2024

(30) Foreign Application Priority Data

Sep. 29, 2022 (JP) ..... 2022-156504

(51) Int. Cl.
*B65H 29/14* (2006.01)

(52) U.S. Cl.
CPC ..... *B65H 29/14* (2013.01); *B65H 2511/11* (2013.01); *B65H 2511/15* (2013.01); *B65H 2511/416* (2013.01); *B65H 2601/22* (2013.01)

(58) Field of Classification Search
CPC . B65H 29/14; B65H 29/125; B65H 2511/416
See application file for complete search history.

(56) References Cited

U.S. PATENT DOCUMENTS

| | | | | |
|---|---|---|---|---|
| 8,128,085 | B2 * | 3/2012 | Seki | B65H 29/125 271/213 |
| 9,891,571 | B2 * | 2/2018 | Sato | B65H 29/14 |
| 10,150,637 | B2 * | 12/2018 | Wakayama | B65H 31/3009 |
| 10,604,371 | B2 * | 3/2020 | Kotani | B65H 29/70 |
| 10,745,231 | B2 * | 8/2020 | Deocon Mir | B65H 31/26 |
| 10,822,192 | B2 * | 11/2020 | Kotani | B65H 43/08 |

(Continued)

FOREIGN PATENT DOCUMENTS

| | | | |
|---|---|---|---|
| JP | 2007-106041 | A | 4/2007 |
| JP | 2016-074513 | A | 5/2016 |

(Continued)

*Primary Examiner* — Patrick Cicchino
(74) *Attorney, Agent, or Firm* — Scully, Scott, Murphy & Presser, P.C.

(57) ABSTRACT

An image forming apparatus includes a medium accommodating part, an image forming engine, a discharge part, a medium conveyer configured to convey a medium from the medium accommodating part to the image forming engine and to the discharge part, a medium holder configured to hold the medium discharged to the discharge part, and a controller. The controller selects a first discharge mode for causing the medium holder to continue to hold the medium when a holding condition is satisfied or a second discharge mode for causing the medium holder not to hold the medium or to hold the medium for a prescribed period and then release the medium. The holding condition includes at least one of a first condition being that material of the medium does not correspond to specific materials and a second condition being that a medium length is less than a first threshold value.

14 Claims, 7 Drawing Sheets

(56) References Cited

U.S. PATENT DOCUMENTS

| | | | | |
|---|---|---|---|---|
| 11,377,319 | B2 * | 7/2022 | Kotani | B65H 29/40 |
| 2015/0246560 | A1 * | 9/2015 | Nakamura | B65H 31/02 271/182 |
| 2016/0282796 | A1 * | 9/2016 | Tanaka | B65H 43/00 |
| 2021/0300081 | A1 * | 9/2021 | Takahashi | B41J 11/663 |
| 2021/0373476 | A1 * | 12/2021 | Tobinaga | B65H 9/166 |

FOREIGN PATENT DOCUMENTS

| | | | | |
|---|---|---|---|---|
| JP | 2021-160840 | A | | 10/2021 |
| KR | 20160136106 | A | * | 11/2016 |

* cited by examiner

| NO. | Classification of Sheet P | Tendency to Become Curled | Length of Sheet P | | |
|---|---|---|---|---|---|
| | | | Threshold Value A or Less | Between Threshold Values A and B | Threshold Value B or More |
| 1 | (a) | high | Mode 2 (No Holding) | Mode 1 | Mode 2 (No Holding) |
| 2 | (b) | ↕ | Mode 2 (No Holding) | Mode 1 | Mode 2 (Temporal[T1]) |
| 3 | (c) | | Mode 2 (No Holding) | Mode 1 | Mode 2 (Temporal[T2]) |
| 4 | (d) | low | Mode 2 (No Holding) | Mode 1 | Mode 1 |

FIG. 6

IMAGE FORMING APPARATUS

REFERENCE TO RELATED APPLICATIONS

This application claims priority from Japanese Patent Application No. 2022-156504 filed on Sep. 29, 2022. The entire content of the priority application is incorporated herein by reference.

BACKGROUND ART

Aspects of the present disclosure relate to an image forming apparatus having a discharge section through which a medium on which an image is formed is to be discharged.

There is known an image forming apparatus including means configured to discharge a medium on which an image is formed while keeping the discharged medium nipped in order to prevent the discharged medium from falling off the apparatus. In such image forming apparatus, when a length of a sheet being the medium exceeds a threshold value, the discharged sheet is held between discharge rollers.

DESCRIPTION

The inventors of the present application have noticed that, when the discharged medium is held by discharge rollers or the like, the medium may become curled.

At least one aspect of the present disclosure is advantageous to provide an image forming apparatus configured to control an operation for holding a discharged medium so that the medium is less likely to become curled.

According to aspects of the present disclosure, there is provided an image forming apparatus including a medium accommodating part configured to accommodate a medium, an image forming engine configured to form an image on the medium accommodated in the medium accommodating part, a discharge part configured to receive the medium on which the image has been formed by the image forming engine, a medium conveyer configured to convey the medium accommodated in the medium accommodating part to the image forming engine along a conveying direction and conveying the medium on which the image has been formed by the image forming engine to the discharge part, a medium holder configured to hold the medium discharged to the discharge part in a state hanged from the discharge part, and a controller. The controller is configured to select a first discharge mode for causing the medium holder to continue to hold the medium discharged to the discharge part when a holding condition is satisfied or a second discharge mode for causing the medium holder not to hold the medium discharged to the discharge part or to hold the medium discharged to the discharge part for a prescribed period and then release the medium, and control the operations of the image forming engine, the medium conveyer and the medium holder based on the selected discharge mode. The holding condition includes at least one of a first condition being that material of the medium does not correspond to specific materials and a second condition being that a medium length of the medium in the conveying direction is less than a first threshold value.

According to aspects of the present disclosure, there is further provided an image forming apparatus including a medium accommodating part configured to accommodate a medium, an image forming engine configured to form an image on the medium accommodated in the medium accommodating part, a discharge part configured to receive the medium on which the image has been formed by the image forming engine, a medium conveyer configured to convey the medium accommodated in the medium accommodating part to the image forming engine along a conveying direction and conveying the medium on which the image has been formed by the image forming engine to the discharge part, a medium holder configured to hold the medium discharged to the discharge part in a state hanged from the discharge part, and a controller. The controller is configured to cause the medium holder to continue to hold the medium discharged to the discharge part when a medium length of the medium in the conveying direction is less than a first threshold value, and cause the medium holder not to hold the medium discharged to the discharge part when a medium length of the medium in the conveying direction is equal to or greater than the first threshold value.

According to aspects of the present disclosure, there is further provided an image forming apparatus including a medium accommodating part configured to accommodate a medium, an image forming engine configured to form an image on the medium accommodated in the medium accommodating part, a discharge part configured to receive the medium on which the image has been formed by the image forming engine, a medium conveyer configured to convey the medium accommodated in the medium accommodating part to the image forming engine along a conveying direction and conveying the medium on which the image has been formed by the image forming engine to the discharge part, a medium holder configured to hold the medium discharged to the discharge part in a state hanged from the discharge part, and a controller configured to control the medium holder such that the higher a tendency to become curled of material of the medium is, the shorter a time period in which to hold the medium discharged to the discharge part becomes.

FIG. 6 illustrates a table for a selection of a discharge mode.

EMBODIMENT

Hereinafter, a printer 100 according to aspects of the present disclosure will be described with reference to FIGS. 1 to 5. The up-down direction, front-rear direction, and left-right direction shown in FIG. 1 are herein referred to as the up-down direction, front-rear direction, and left-right direction of the printer 100.

Figure 1:
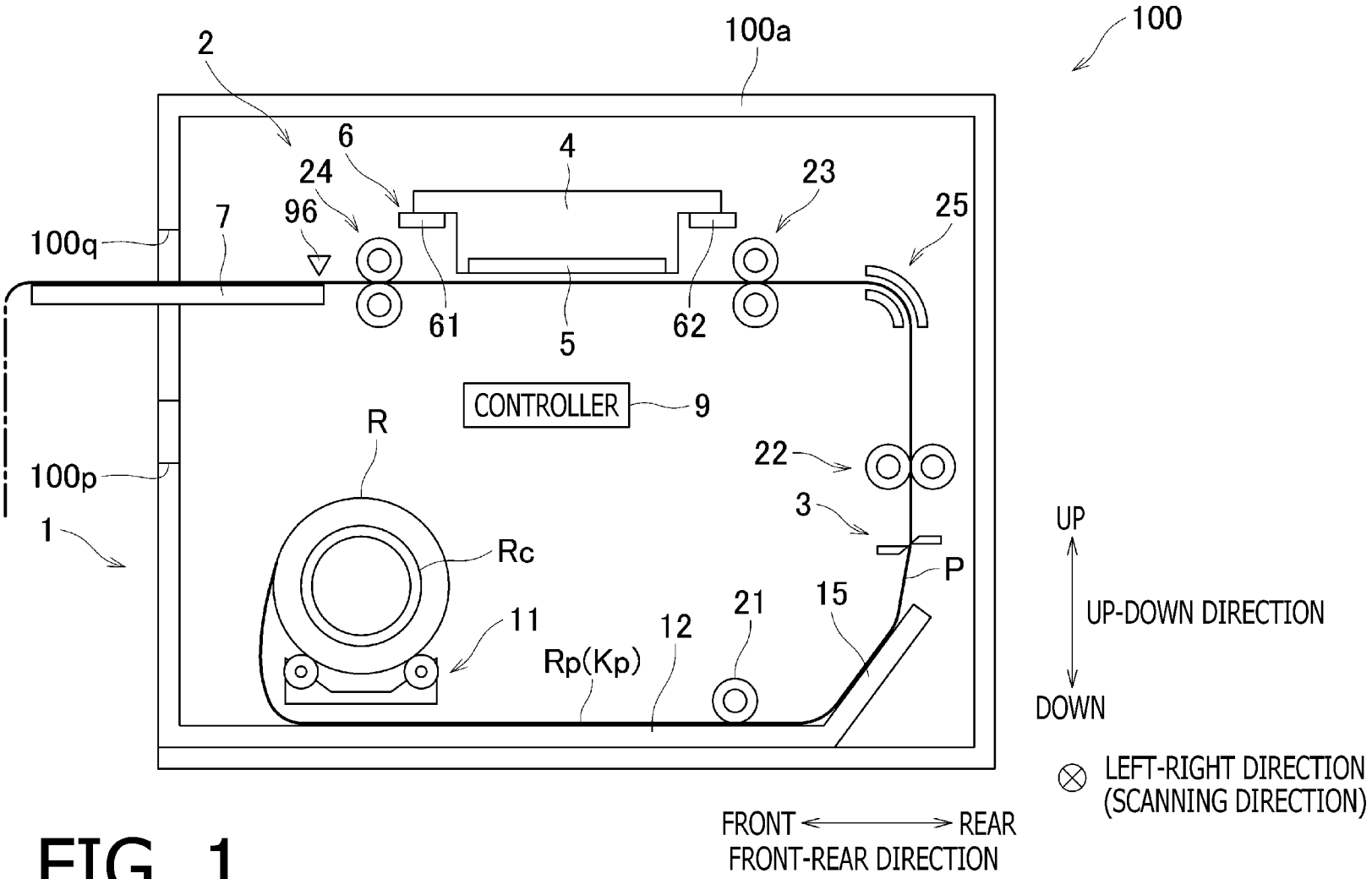
FIG. 1 is a schematic side view showing an internal structure of a printer according to aspects of the present disclosure.

As shown in FIG. 1, the printer 100 mainly includes a housing 100*a*, a feed tray 1, a conveying mechanism 2, a cutter 3, a carriage 4, a head 5, a moving mechanism 6, a discharge tray 7, and a controller 9.

The feed tray 1 is a member configured to accommodate sheets P to be used for image formation. The sheet P according to aspects of the present disclosure includes a long roll sheet Rp and a cut sheet Kp shorter than the roll sheet Rp. The cut sheet Kp is a standard-sized sheet of, for example, A4 size or B5 size. The feed tray 1 is configured to accommodate a roll body R and the cut sheets Kp. The roll body R is formed by winding the roll sheet Rp in a roll shape around an outer peripheral surface of a cylindrical core member Rc. The feed tray 1 may be configured to accommodate the roll body R and the cut sheets Kp at the same time or may be configured to selectively accommodate either the roll body R or the cut sheets Kp. In the illustrated embodiment, the roll sheet Rp and the cut sheet Kp are made of paper, but a medium made of material other than paper such as cloth may be alternatively or additionally used.

The feed tray 1 includes a roll body support 11 configured to support the roll body R, and a placement surface 12 on which the cut sheet Kp are to be placed. The feed tray 1 is disposed inside the housing 100*a* below the head 5. The cut sheets Kp are placed on the placement surface 12 in a stacked state. The feed tray 1 is configured to be inserted into and removed from the housing 100*a* in the front-rear direction through an opening 100*p* formed on a front wall of the housing 100*a*.

The discharge tray 7 is disposed inside the housing 100*a* in front of the head 5 and above the feed tray 1. The discharge tray 7 extends in the front-rear direction.

The conveying mechanism 2 executes a conveying operation of conveying the sheet P accommodated in the feed tray 1 toward the head 5 and discharging the sheet P on which an image has been formed by the head 5 to the discharge tray 7. The sheet P is conveyed through a conveying path (a path along a thick solid line representing the roll sheet Rp in FIG. 1) extending from the feed tray 1 to the discharge tray 7 via the head 5. Hereinafter, the terms "upstream" and "downstream" represent upstream and downstream in the conveying direction of the sheet P along this conveying path.

The conveying mechanism 2 includes a feed roller 21, an intermediate roller pair 22, a conveying roller pair 23, a discharge roller pair 24, and a guide member 25 as a configuration for executing the conveying operation. The feed roller 21, the intermediate roller pair 22, the conveying roller pair 23, and the discharge roller pair 24 are arranged in this order in the conveying direction along the conveying path.

The feed roller 21 feeds the roll sheet Rp unwound from the roll body R supported by the roll body support 11 or the cut sheet Kp placed on the placement surface 12 from the feed tray 1.

Figure 2:
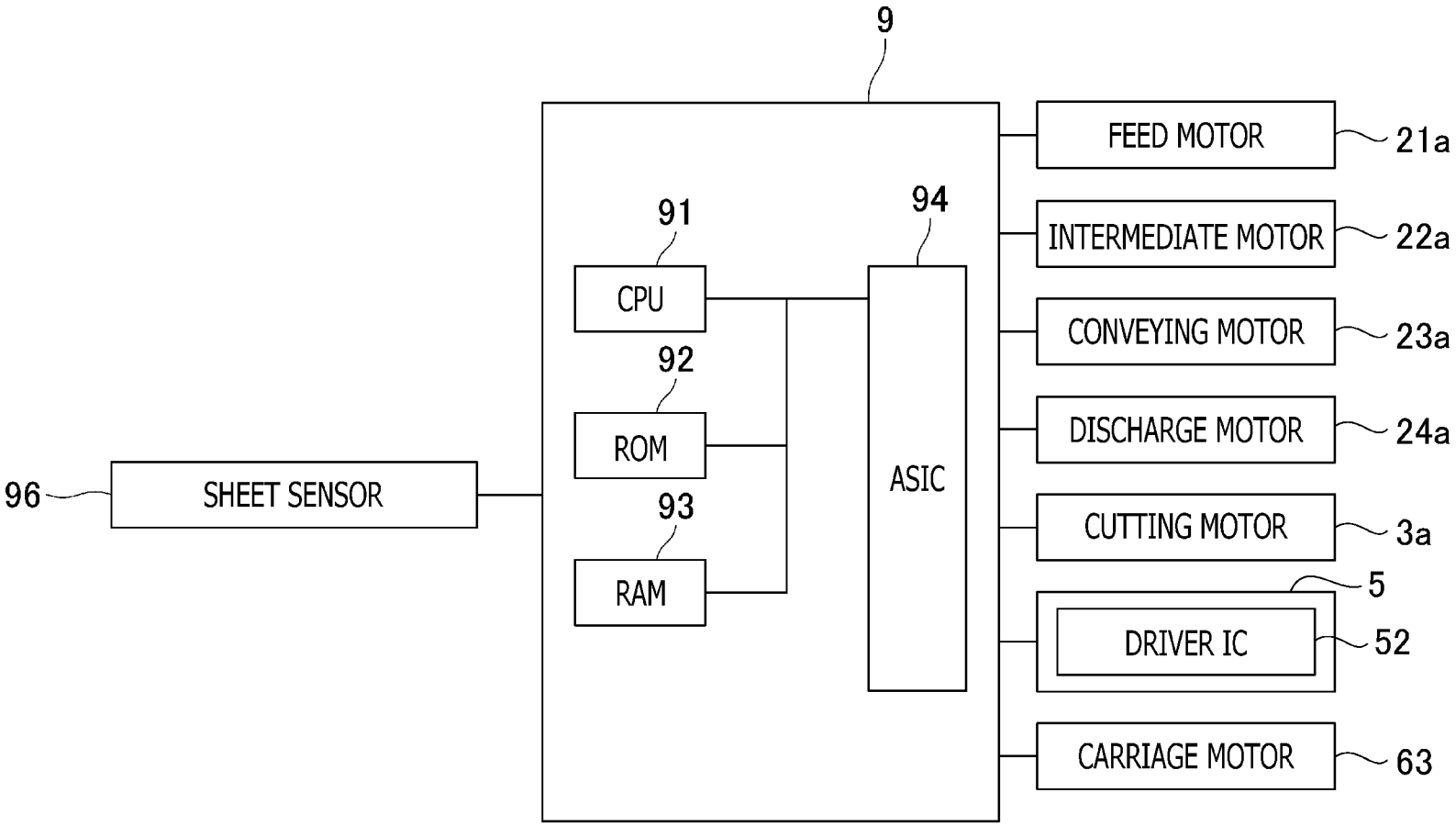
FIG. 2 is a block diagram showing an electrical configuration of the printer shown in FIG. 1.

The feed roller 21 is driven to rotate by a feed motor 21*a* (see FIG. 2). When the feed motor 21*a* is driven under control of the controller 9, the feed roller 21 rotates, and a conveying force in the direction from the front to the rear is applied to the sheet P that is in contact with the feed roller 21. Thereby, the sheet P is fed from the feed tray 1. A rear wall 15 provided at a rear end portion of the feed tray 1 is inclined so that an upper end thereof is located behind a lower end thereof. Therefore, the sheet P fed from the feed tray 1 moves obliquely upward.

The intermediate roller pair 22 includes a drive roller that rotates as an intermediate motor 22*a* (see FIG. 2) is driven, and a driven roller that rotates along with the driving roller. When the intermediate motor 22*a* is driven under control of the controller 9, the intermediate roller pair 22 rotates while nipping the sheet P and conveys the sheet P. The intermediate roller pair 22 is located above the rear end portion of the feed tray 1. The intermediate roller pair 22 conveys the sheet P, which has been fed from the feed tray 1 by the feed roller 21 and is moving obliquely upward, upward while nipping the sheet P.

The guide member 25 is disposed above the intermediate roller pair 22. The guide member 25 guides the sheet P conveyed upward by the intermediate roller pair 22 forward.

The conveying roller pair 23 consists of a drive roller that rotates a conveying motor 23*a* (see FIG. 2) is driven, and a driven roller that rotates along with the drive roller. The discharge roller pair 24 consists of a drive roller that rotates as a discharge motor 24*a* (see FIG. 2) is driven, and a driven roller that rotates along with the drive roller. The conveying roller pair 23 and the discharge roller pair 24 are disposed on both sides of the head 5 in the front-rear direction. The conveying roller pair 23 is disposed behind the head 5 (upstream in the conveying direction), and the discharge roller pair 24 is arranged in front of the head 5 (downstream of the head 5 in the conveying direction).

When the conveying motor 23*a* and the discharge motor 24*a* are driven under the control of the controller 9, the conveying roller pair 23 and the discharge roller pair 24 rotate while nipping the sheet P to convey the sheet P. The conveying roller pair 23 conveys the sheet P guided by the guide member 25 to a position facing the lower surface of the head 5. At the position facing the lower surface of the head 5, an image is formed on an image forming surface, which is an upper surface of the sheet P, by an image forming operation of the head 5 described later. The discharge roller pair 24 receives the sheet P fed by the conveying roller pair 23 and sends the sheet P further forward. The sheet P conveyed by the discharge roller pair 24 is discharged on the discharge tray 7.

As described later, when discharging the sheet P on the discharge tray 7, if a prescribed condition is satisfied, the discharge roller pair 24 executes a holding operation of keeping nipping a rear end portion (an upstream end portion in the conveying direction) of the sheet P. As a result, as shown with a one dot chain line in FIG. 1, the sheet P discharged on the discharge tray 7 is thereby held in a state hanged from a front end of the discharge tray 7. Thus, falling of the sheet P from the front end of the discharge tray 7 is suppressed. In this state, a user pulls the sheet P out of the discharge roller pair 24 or causes the discharge roller pair 24 to restart the conveyance of the sheet P, so that the sheet P on which the image has been formed is separated from the discharge roller pair 24.

A sheet sensor 96 is provided near a downstream side of the discharge roller pair 24. The sheet sensor 96 is configured to detect whether the sheet P is present at the position where the sheet sensor 96 is provided. The detection result is output to the controller 9. Based on the detection result of the sheet sensor 96, the controller 9 can detect whether the sheet P hanged from the front end of the discharge tray 7 due to the holding operation by the discharge roller pair 24 has been collected by the user.

The cutter 3 executes a cutting operation of cutting the roll sheet Rp on which an image has been formed by the head 5. The cutter 3 is disposed upstream of the intermediate roller pair 22 in the conveying path and between the rear end portion of the feed tray 1 and the intermediate roller pair 22. The cutter 3 includes, for example, a disc-shaped rotating blade and a driven blade. In the cutting operation, the rotating blade rotates as a cutting motor 3*a* (see FIG. 2) is driven and reciprocates in the left-right direction. The roll sheet Rp that has been unwound from the roll body R and conveyed is cut in the width direction of the roll sheet Rp by the cutter 3 by driving the cutting motor 3*a* under the control of the controller 9 so that a length of the cut-off roll sheet Rp in the conveying direction becomes a cutting length indicated by image data described later. As a result, a rear end is formed to the cut-off roll sheet Rp, and each cut-off roll sheet Rp is discharged to the discharge tray 7.

The head 5 includes a plurality of nozzles formed on a lower surface thereof and a driver IC 52 (see FIG. 2). When the driver IC 52 is driven under the control of the controller 9, ink is ejected from the nozzles, and the ink adheres to the sheet P to form dots. The head 5 is mounted on the carriage 4.

The moving mechanism 6 includes two guide rails 61 and 62 and a carriage motor 63 (see FIG. 2). The two guide rails 61 and 62 are spaced apart from each other in the front-rear direction and extend in the left-right direction. The carriage 4 is disposed to lie astride the two guide rails 61 and 62. The carriage 4 is connected to the carriage motor 63 via a conventionally-known belt or the like. When the carriage motor 63 is driven under the control of the controller 9, the carriage 4 moves in a scanning direction (left-right direction) along the guide rails 61 and 62.

The head 5 executes an image forming operation on the sheet P in the following manner. Dots are sequentially formed in the scanning direction by ink ejected while the head 5 reciprocates in the scanning direction due to the movement of the carriage 4. Rows of dots in the scanning direction are sequentially formed while the sheet P is conveyed by the conveying mechanism 2. Dots are arranged in both the scanning direction and the conveying direction in an image forming area on the sheet P, and an image having such a dot arrangement appears. The image forming area is a rectangular area corresponding to a size of the image.

A cartridge mounting part is provided in the housing 100*a*. Four ink cartridges storing black, yellow, cyan, and magenta inks can be detachably mounted to the cartridge mounting part. Inks are supplied to the head 5 from the ink cartridges mounted in the cartridge mounting part via tubes or the like.

The controller 9 controls the entire printer 100. As shown in FIG. 2, the feed motor 21*a*, the intermediate motor 22*a*, the conveying motor 23*a*, the discharge motor 24*a*, the cutting motor 3*a*, the driver IC 52, the carriage motor 63, and the sheet sensor 96 are electrically connected to the controller 9.

As shown in FIG. 2, the controller 9 includes a Central Processing Unit (CPU) 91, a Read Only Memory (ROM) 92, a Random Access Memory (RAM) 93, an Application Specific Integrated Circuit (ASIC) 94, and the like.

The ROM 92 stores programs to be executed by the CPU 91 and the ASIC 94. The ROM 92 also stores various reference values. For example, the reference values include values for determining whether to cause the discharge roller pair 24 to continue the holding operation such as values indicating types of material of the sheet P (hereinafter referred to as "type(s) of the sheet P") and threshold values of a length of the sheet P. The types of the sheet P include plain paper, glossy paper, inkjet paper, cloth, and the like. Different types of the sheet P means different materials of the sheet P. The threshold values of the length of sheet P include two values: a threshold value A and a threshold value B (A and B being real numbers satisfying A<B). The threshold values of the length of the sheet P may be changeable in accordance with a user input through an input device provided to the printer 100, or may be set based on data transmitted from an external device such as a PC. Thus, the user can appropriately set the threshold value B, which is a control condition for the holding operation of the sheet P as will be described later, in consideration of installation conditions such as a height of an installation position of the printer 100 from the floor surface. The reference values stored in the ROM 92 include lengths of periods T1 and T2 (T1 and T2 being real numbers satisfying T1<T2) during which to cause the discharge roller pair 24 to execute the holding operation in a temporary holding operation described later.

The RAM 93 is for temporarily storing data necessary for executing programs. This data includes image data transmitted from an external device such as a PC or read from a recording medium. The image data includes data indicating an image to be formed on the sheet P and data indicating a user's instruction regarding information related to the image formation. The related information includes information indicating which of the cut sheet Kp and the roll sheet Rp to use, information indicating the cutting length in the conveying direction when the roll sheet Rp is to be used, information indicating the type of the sheet P to be used, and the like.

The controller 9 may be one in which only the CPU 91 executes various processes, one in which only the ASIC 94 executes various processes, or one in which the CPU 91 and the ASIC 94 cooperate to executes various processes. The controller 9 may be one in which one CPU 91 executes processes independently, or one in which a plurality of CPUs 91 share execution of processes. The controller 9 may be one in which one ASIC 94 executes processes independently, or one in which a plurality of ASICs 94 execute processes in a shared manner. The controller 9 executes an image forming process based on the image data stored in a RAM (93). In the image forming process, a process of conveying the sheet P along the conveying path with the conveying mechanism 2 by a prescribed distance and a process of ejecting ink onto the sheet P from the plurality of nozzles of the head 5 while causing the carriage 4 to reciprocate in the scanning direction with the moving mechanism 6 are alternately and repeatedly executed.

When the sheet P is the roll sheet Rp, the roll sheet Rp receives the ink ejected from the head 5 while being conveyed by the conveying mechanism 2. The roll sheet Rp is cut off into the cutting length indicated by the image data by the operation of the cutter 3 under the control of the controller 9. The roll sheet Rp cut off by the cutter 3 becomes a sheet on which the image indicated by the image data is formed, and is discharged on the discharge tray 7.

When the sheet P is the cut sheet Kp, the cut sheet Kp receives the ink ejected from the head 5 while being conveyed by the conveying mechanism 2. As a result, the cut sheet Kp becomes a sheet on which the image indicated by the image data is formed, and is discharged on the discharge tray 7.

In the above-mentioned image forming process, the controller 9 selects one of a first discharge mode and a second discharge mode when discharging the sheet P on the discharge tray 7, and controls the conveying mechanism 2 and the head 5 based on the selected mode. The first discharge mode is a mode in which the discharge roller pair 24 is caused to nip the rear end portion of the sheet P (the end portion on the upstream side in the conveying direction of the sheet P) to execute the holding operation of keeping the sheet P in a state hanged from the front end of the discharge tray 7 as shown by the one dot chain line in FIG. 1. Specifically, in the control of the conveying mechanism 2, when discharging the sheet P on the discharge tray 7, the discharge roller pair 24 is caused to stop when the discharge roller pair 24 is nipping the rear end portion of the sheet P.

The falling of the sheet P from the front end of the discharge tray 7 is thereby suppressed. In the first discharge mode, the holding operation of the sheet P by the discharge roller pair 24 continues until the user pulls the sheet P out of the discharge roller pair 24.

The second discharge mode is a mode in which one of a temporary holding operation and a discharge operation without holding operation is performed. The temporary holding operation is an operation in which the discharge roller pair 24 temporarily executes the holding operation of the sheet P, and when the sheet P is not pulled out from the discharge roller pair 24 even after a prescribed time period elapses in a state in which the holding operation is executed, the discharge roller pair 24 stops the holding operation. The stop of the holding operation is performed by causing the discharge roller pair 24 to resume the conveyance of the sheet P so that the rear end portion of the sheet P passes through the discharge roller pair 24 and then stopping the driving of the discharge roller pair 24. The prescribed time period for which to continue the holding operation is either T1 or T2 stored in the ROM 92. Whether or not the sheet P has been pulled out from the discharge roller pair 24 is determined by the controller 9 based on the detection result of the sheet sensor 96.

The discharge operation without holding operation of the second discharge mode is a mode in which the sheet P is discharged on the discharge tray 7 without causing the discharge roller pair 24 to execute the holding operation of the sheet P. Specifically, in the conveying operation of the conveying mechanism 2, when discharging the sheet P on the discharge tray 7, the driving of the discharge roller pair 24 is stopped after the rear end portion of the sheet P passes through the discharge roller pair 24.

The controller 9 selects one of the first discharge mode, the temporary holding operation of the second discharge mode, and the discharge operation without holding operation of the second discharge mode based on a condition related to both the type of the sheet P and the length of the sheet P. This control is based on the above-mentioned viewpoint of suppressing falling of the sheet P from the discharge tray 7 as well as a viewpoint of suppressing the sheet P from being curled due to the manner in which the sheet P is discharged. When the type of the sheet P relates to material that is easy to be deformed such as glossy paper, or the sheet P is long enough to come into contact with the floor surface when the sheet P is held by the discharge roller pair 24 by the holding operation so that the sheet P is held in a curved state, the above-mentioned curling may occur.

Figure 3:
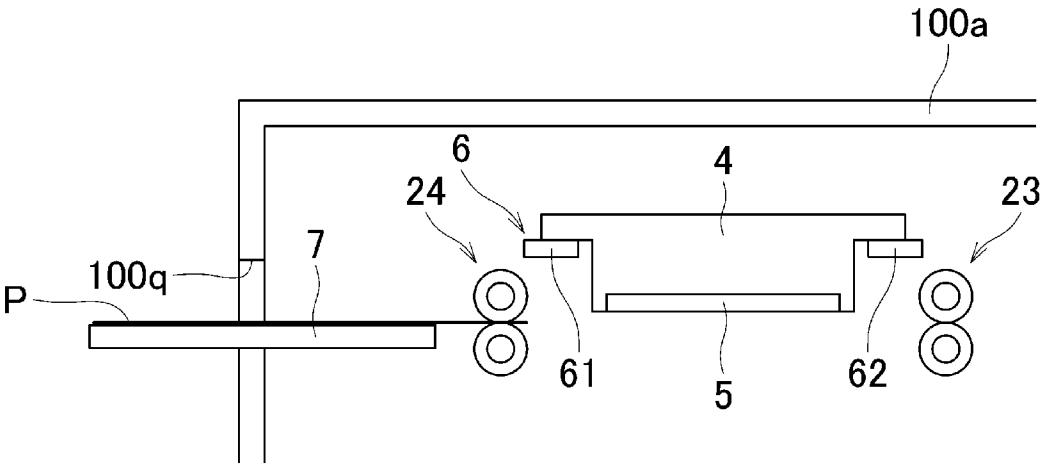
FIG. 3 is a partial enlarged view of FIG. 1 showing a periphery of a discharge tray in a state in which a sheet is discharged.
Figure 4:
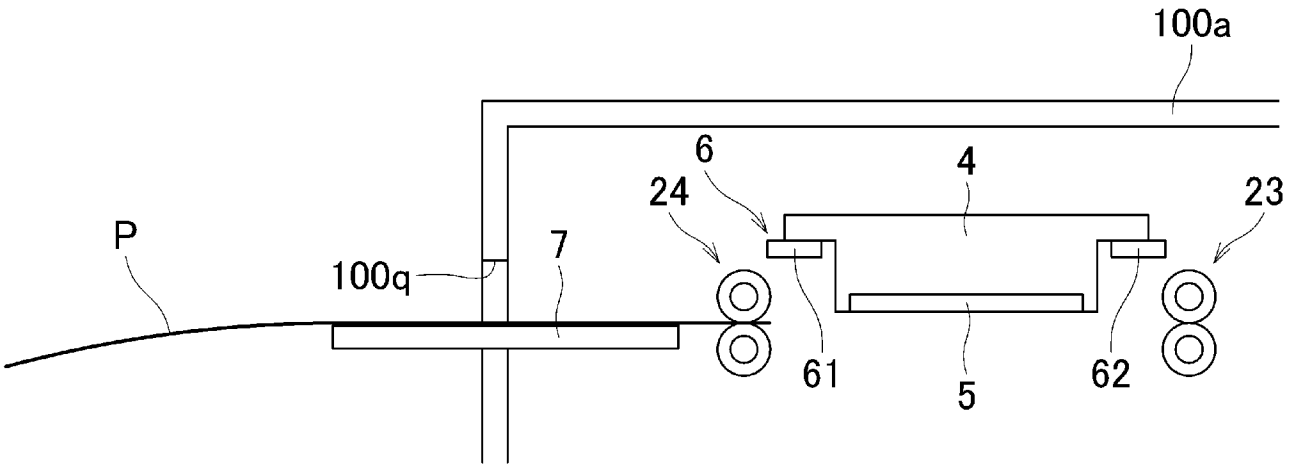
FIG. 4 is a partial enlarged view of FIG. 1 showing the periphery of the discharge tray in another state in which the sheet is discharged.
Figure 5:
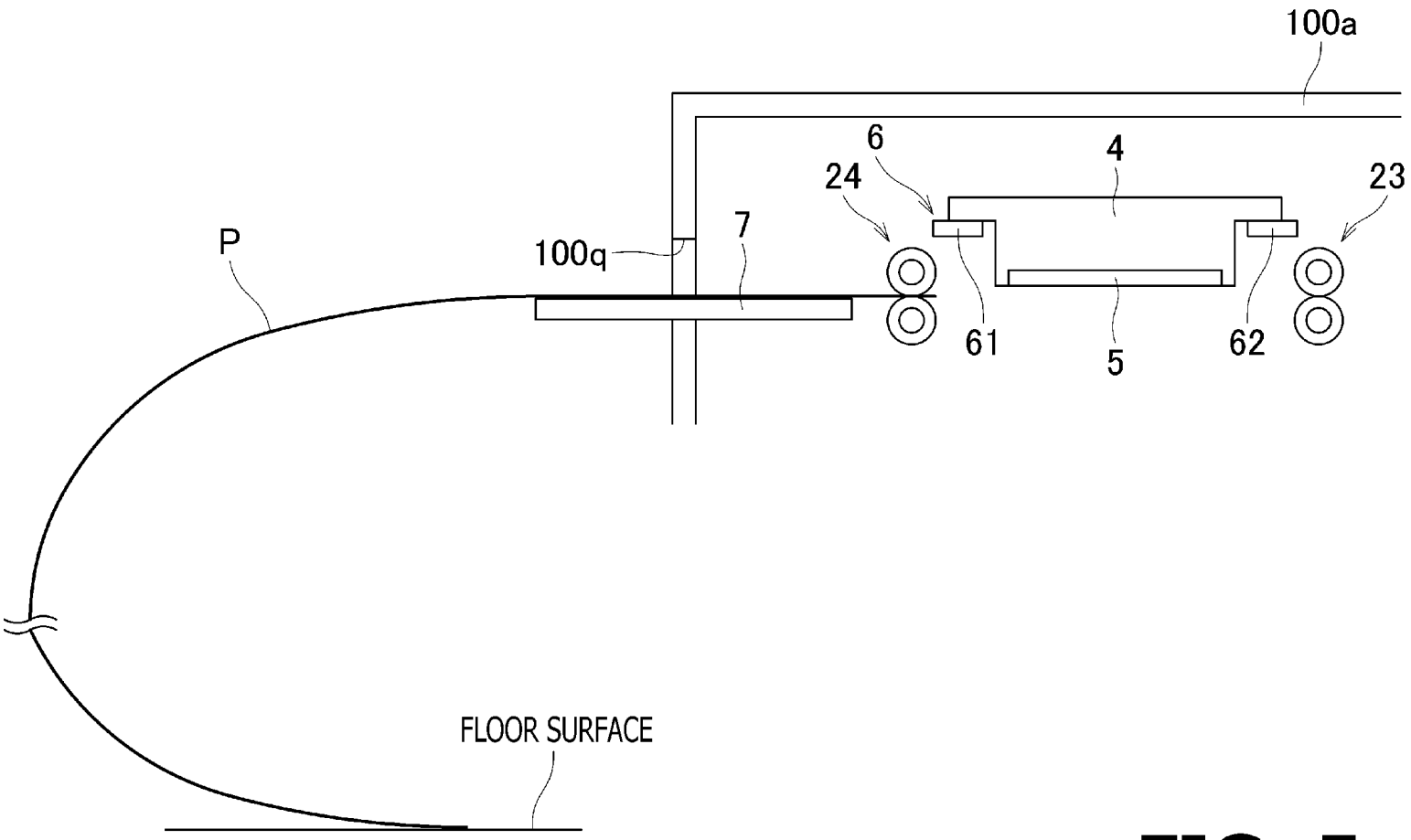
FIG. 5 is a partial enlarged view of FIG. 1 showing the periphery of the discharge tray in still another state in which the sheet is discharged.

With regard to the length of the sheet P, for example, as shown in FIG. 3, when the sheet P to be discharged is short to some extent, the sheet P hardly falls from the discharge tray 7 even if the discharge roller pair 24 is not caused to execute the holding operation. In the case shown in FIG. 4 in which the sheet P to be discharged is relatively long, the sheet P is likely to move out from the discharge tray 7 and fall. Therefore, falling of the sheet P from the discharge tray 7 is suppressed by causing the discharge roller pair 24 to execute the holding operation and suspending the sheet P above the floor surface. On the other hand, when the sheet P to be discharged is longer, when the discharge roller pair 24 is caused to execute the holding operation, as shown in FIG. 5, a lower end portion of the sheet P may reach the floor surface and a portion of the sheet P that has moved out from the discharge tray 7 may become greatly curved. If the sheet P is held in such a state, if the sheet P is made of material that easily gets curled, the sheet P become curled.

Therefore, in the present embodiment, the discharge mode is selected based on the condition relating to both the type of the sheet P and the length of the sheet P in order to make the discharged sheet P less likely to become curled. A table of FIG. 6 shows an example of such a selection by the controller 9.

The "Length of Sheet P" in the table of FIG. 6 corresponds to the cutting length of the roll sheet Rp and the length of the standard-sized cut sheet Kp in a direction corresponding to the conveying direction. The "Threshold Value A" and "Threshold Value B" in the table of FIG. 6 are reference values acquired from the ROM 92. "Threshold Value A or Less" means that the length of the sheet P is equal to or less than the threshold value A. "Between Threshold Values A and B" means that the length of the sheet P is greater than the threshold value A and smaller than the threshold value B. "Threshold Value B or more" means that the length of the sheet P is equal to or greater than the threshold value B. The length of the sheet P being equal to or less than the threshold value A corresponds to the sheet P being expected to be short enough not to fall from the discharge tray 7, as shown in FIG. 3. The length of the sheet P being greater than the threshold value A and smaller than the threshold value B corresponds to the sheet P being long enough to fall from the discharge tray 7 unless the holding operation by the discharge roller pair 24 is executed but not long enough to curve and contact the floor surface, as shown in FIG. 4. The length of the sheet P being equal to or greater than the threshold value B corresponds to the sheet P being long enough to curve and reach the floor surface, as shown in FIG. 5.

The "Classification of Sheet P" in the table of FIG. 6 indicates whether the type of the sheet P indicated by the image data stored in the RAM 93 corresponds to (a), (b), (c), or (d). (a), (b), (c), and (d) are arranged in the order of tendency to become curled, and the lower one in the list corresponds to material that is less likely to become curled than the higher one in the list. (a), (b), (c), and (d) correspond to, for example, any one of glossy paper, inkjet paper, plain paper, and cloth.

"Mode 1" in the table of FIG. 6 means the first discharge mode, "Mode 2 (No Holding)" means the discharge operation without holding operation of the second discharge mode, and "Mode 2 (Temporal [T1])" means that the temporary holding operation of the second discharge mode is executed by a time period of T1 as described above. "Mode 2 (Temporal [T2])" means that the temporary holding operation of the second discharge mode is executed by a time period of T2 as described above.

The controller 9 selects one of the first discharge mode and the second discharge mode in accordance with the contents of the table in the table of FIG. 6, and controls the conveying mechanism 2 and the head 5 based on the selected mode. Specifically, when the type of the sheet P indicated by the image data stored in the RAM 93 corresponds to (a), when the length of the sheet P is equal to or less than the threshold value A, the discharge operation without holding operation of the second discharge mode is executed; when the length of the sheet P is greater than the threshold value A and smaller than the threshold value B, the first discharge mode is executed; and when the length of the sheet P is greater than the threshold value B, the discharge operation without holding operation of the second discharge mode is executed. When the type of the sheet P indicated by the image data stored in the RAM 93 corresponds to (b), when the length of the sheet P is smaller than the threshold value A, the discharge operation without holding operation of the second discharge mode is executed; when the length of the sheet P is greater than the threshold value A and smaller than the threshold value B, the operation of the first discharge mode is executed, and when the length of the sheet P is greater than the threshold value B, the temporary holding operation of the second discharge mode is executed for the time period T1. When the type of the sheet P indicated by the image data stored in the RAM 93 corresponds to (c), when the length of the sheet P is smaller than the threshold value A, the discharge operation without holding operation of the second discharge mode is executed; when the length of the sheet P is greater than the threshold value A and smaller than the threshold value B, the operation of the first discharge mode is executed, and when the length of the sheet P is greater than the threshold value B, the temporary holding operation of the second discharge mode is executed for the time period T2. When the type of the sheet P indicated by the image data stored in the RAM 93 corresponds to (d), when the length of the sheet P is smaller than the threshold value A, the discharge operation without holding operation of the second discharge mode is executed, and when the length of the sheet P is greater than the threshold value A, the operation of first discharge mode is executed regardless of whether the length of the sheet P is less than or greater than the threshold value B.

According to the above-described control according to the contents of the table in FIG. 6, regardless of the type of the sheet P, when the length of the sheet P is equal to or less than the threshold value A, the sheet P is discharged without executing the holding operation by the discharge roller pair 24. On the other hand, when the length of the sheet P is greater than the threshold value A and smaller than the threshold value B, the holding operation by the discharge roller pair 24 is executed. Therefore, the falling of the sheet P from the discharge roller pair 24 is appropriately suppressed.

In contrast, when the length of the sheet P is equal to or greater than the threshold value B, the following control is executed according to the material of the sheet P. In the case of (d) corresponding to the material of the sheet P which the tendency to become curled is the highest among (a) to (d), the sheet P is discharged without executing the holding operation by the discharge roller pair 24. Thus, the sheet P does not become in the state shown in FIG. 5 and curling of the sheet P is suppressed. In the case of (b) corresponding to the material of the sheet P of which the tendency to become curled is the second highest after the material of the sheet P corresponding to (a) among (a) to (d), the holding operation by the discharge roller pair 24 is performed once, but if the sheet P is not pulled out within the time period T1, the holding operation is canceled. Thus, the sheet P is not held in the state shown in FIG. 5 for a long time and curling of the sheet P is suppressed. In the case of (c) corresponding to the material of the sheet P of which the tendency to become curled is the third highest after the material of the sheet P corresponding to (b) among (a) to (d), the holding operation by the discharge roller pair 24 is performed once, but if the sheet P is not pulled out within the time period T2, the holding operation is canceled. Thus, the sheet P is not held in the state shown in FIG. 5 for a long time and curling of the sheet P is suppressed. Since the tendency to become curled of the material of the sheet P corresponding to (c) is lower than that of the material of the sheet P corresponding to (b), the maximum time period T2 of the holding operation for (c) is set longer than the maximum time period T1 of the holding operation for (b). In the case of the material of the sheet P corresponding to (d) of which the tendency to become curled is the lowest among (a) to (d), the holding operation is continued until the sheet P is pulled out by the user.

In the table of FIG. 6, when the length of the sheet P is equal to or greater than the threshold value B, the first discharge mode is selected when the type of the sheet P corresponds to (d), and the second discharge mode is selected when the type of the sheet P corresponds to (a) to (c).

In the table of FIG. 6, when the type of the sheet P corresponds to any one of (a) to (c), the first discharge mode is selected when the length of the sheet P is less than the threshold value B, and the second discharge mode is selected when the length of the sheet P is equal to or greater than the threshold value B.

In the table of FIG. 6, when the length of the sheet P is less than the threshold value B, the first discharge mode is selected when the length of the sheet P is greater than the threshold value A, and the second discharge mode is selected when the length of the sheet P is equal to or less than the threshold value A.

In the table of FIG. 6, when the length of the sheet P is equal to or greater than the threshold value B, the temporary holding operation of the second discharge mode is executed for the time period T1 when the material of the sheet P corresponds to (b), and the temporary holding operation of the second discharge mode is executed for the time period T2 when the material of the sheet P corresponds to (c).

According to the above-described embodiment, the following effects can be obtained. The table of FIG. 6 includes conditions for selecting the first discharge mode such as that the material of the sheet P does not correspond to specific materials and that the length of the sheet P is less than the threshold value B (i.e., that the length of the sheet P is relatively short). If the material of the sheet P corresponds to the specific materials (e.g., the materials corresponding to the above-mentioned (a) to (c)), the sheet P easily becomes curled. If the length of the sheet P is equal to or greater than the threshold value B, the sheet P is likely to become curled because it is long enough to come into contact with the floor surface while being curved, as shown in FIG. 5. In the above-described embodiment, by selecting the second discharge mode when the sheet P is likely to become curled, it is made less likely that the sheet P becomes curled.

According to the above-described embodiment, when the material of the sheet P corresponds to (b), the temporary holding operation of the second discharge mode is executed for the time period T1, and when the material of the sheet P corresponds to (c) which is less likely to become curled than the materials corresponding to (b), the temporary holding operation of the second discharge mode is executed for the time period T2 which is longer than T1. Therefore, the length of the period for which the temporary holding operation is executed is appropriately adjusted according to the easiness of the curling of the sheet P due to the type of the sheet P.

MODIFICATION

Figure 7:
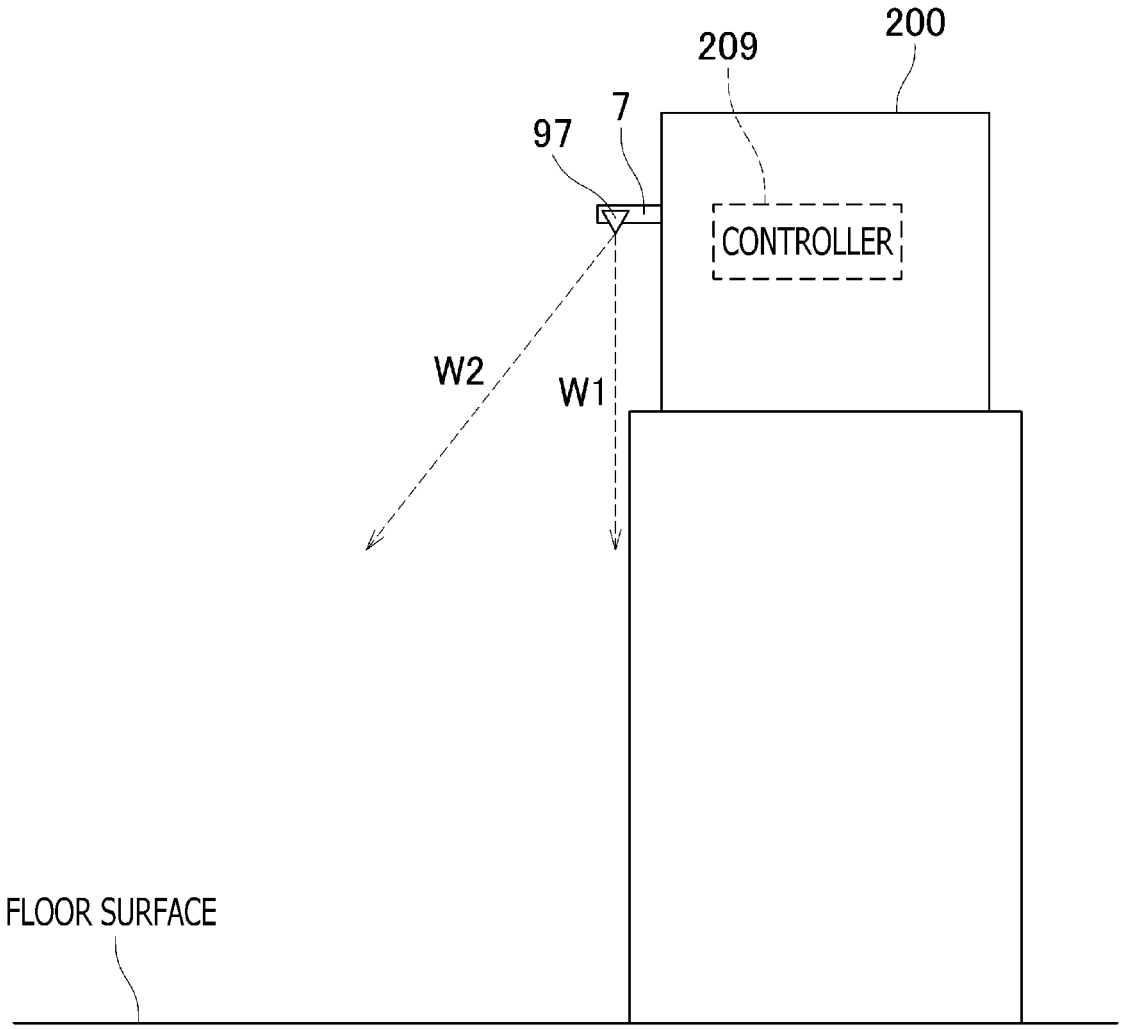
FIG. 7 is a side view showing an installation state of another printer according to aspects of the present disclosure.

A modified printer 200 will be described below with reference to FIG. 7. The printer 200 is different from the above-described printer 100 in that a controller 209 is provided instead of the controller 9 and in that a distance measuring sensor 97 is provided. Other configurations of the printer 200 are the same as the printer 100. The distance measuring sensor 97 is an optical or ultrasonic sensor, and is disposed at any part of the printer 200, for example, at the leading end of the discharge tray 7. The distance measuring sensor 97 detects a distance to the floor surface based on a reflected wave which is a light or ultrasonic wave W1 emitted downward and returned by being reflected by the floor surface, or a scattered wave which is a light or ultrasonic wave W2 emitted obliquely downward and returned by being scattered by the floor surface. The distance to the floor surface indicated by the detection result of the distance measuring sensor 97 is a value corresponding to a height of the discharge tray 7. The controller 209 is different from the controller 9 according to the above-described embodiment in that the threshold value B is adjusted based on the detection result of the distance measuring sensor 97, and other functions of the controller 209 are the same as the controller 9. Based on the detection result of the distance measuring sensor 97, the controller 209 sets the threshold value B to a larger value as the height of the distance measuring sensor 97 from the floor surface increases. Thus, the control of the holding operation by the discharge roller pair 24 is appropriately adjusted according to the height of the installation position of the printer 200.

Further Modifications

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

For example, in the first discharge mode according to the above-described embodiment, it is assumed that the rear end portion of the sheet P is kept nipped by the discharge roller pair 24 in a state where the sheet P is hanged from the discharge tray 7. However, depending on a size of the discharge tray and the cutting length, in the first discharge mode, the rear end portion of the sheet P may be kept nipped by the discharge roller pair 24 in a state where the sheet P is not extending beyond the discharge tray 7 and is not hanged from the discharge tray 7.

In the above-described embodiment, the table of FIG. 6 is used to select one of the first discharge mode and the second discharge mode. The table of FIG. 6 includes both the conditions relating to the material of the sheet P and the conditions relating to the length of the sheet P. However, the selection of the first discharge mode and the second discharge mode may be made based on a condition including only one of the condition relating to the material of the sheet P and the condition relating to the length of the sheet P. For example, the selection of the first discharge mode and the second discharge mode may be made based on only the material of the sheet P regardless of the length of the sheet P. That is, the controller 9 may control the discharge roller pair 24 such that the higher the tendency to become curled of the material of the sheet P is, the shorter a time period in which to hold the sheet P discharged to the discharge tray 7 becomes, regardless of the length of the sheet P. Alternatively, the selection of the first discharge mode and the second discharge mode may be made based on only whether the length of the sheet P is equal to or greater than the threshold value B. That is, the controller may cause the discharge roller pair 24 to continue to hold the sheet P discharged to the discharge tray 7 when the length of the sheet P is less than the threshold value B, and may cause the discharge roller pair 24 not to hold the sheet P discharged to the discharge tray 7 when the length of the sheet P is equal to or greater than the threshold value B, regardless of the material of the sheet P. In the table of FIG. 6, both the threshold value A and the threshold value B are used for the condition relating to the length of the sheet P. However, only the threshold value A may be used for the condition relating to the length of the sheet P. For example, the selection of the first discharge mode and the second discharge mode may be made based on only whether the length of the sheet P exceeds the threshold value A or not when the material of the sheet P corresponds to (d) described above, that is, when the material of the sheet P is least likely to become curled, and the second discharge mode may be selected regardless of the length of the sheet P when the material of the sheet P corresponds to (a) described above, that is, when the material of the sheet P is most likely to become curled.

In the above-described embodiment, in the second discharge mode, either the discharge operation without holding operation or the temporary holding operation can be selected. However, the second discharge mode may only include the discharge operation without holding operation or the temporary holding operation.

In the above-described embodiment, the discharge roller pair 24 is caused to execute the holding operation on the sheet P to be discharged on the discharge tray 7 to hold the sheet P. However, in place of or in addition to the discharge roller pair 24, another means for holding the sheet P to be discharged on the discharge tray 7 may be provided to the printer 100. For example, a mechanism for holding the sheet P to be discharged on the discharge tray 7 by bringing a block-shaped member into contact with the sheet P from above and nipping the sheet P between the member and the discharge tray 7 may be provided to the printer 100. In this case, the block-shaped member may be provided either inside or outside the housing 100*a*. Additionally or alternatively, a suction mechanism may be provided to the printer 100 to suck the sheet P to the discharge tray 7 by sucking air between the sheet P and the discharge tray 7, thereby holding the sheet P.

In the embodiments and modifications described above, aspects of the present disclosure are applied to the printers 100 and 200. However, aspects of the present disclosure may be applied to other inkjet type image forming apparatuses that eject ink from a head, such as multifunction machines and copy machines. Aspects of the present disclosure may also be applied to laser type image forming apparatuses that perform image recording process by causing toner to adhere on the sheet P instead of causing ink to adhere on the sheet P by the inkjet method.

The printer 100 is an example of an "image forming apparatus" according to aspects of the present disclosure. The feed tray 1 is an example of a "medium accommodating part" according to aspects of the present disclosure. The discharge tray 7 is an example of a "discharge part" according to aspects of the present disclosure. The conveying mechanism 2 is an example of a "medium conveyer" according to aspects of the present disclosure. The discharge roller pair 24 and another means for holding the sheet P to be discharged on the discharge tray 7 are examples of a "medium holder" according to aspects of the present disclosure. The head 5 is an example of an "image forming engine" according to aspects of the present disclosure. Among the conditions shown in the table of FIG. 6, the conditions that result in selecting the first discharge mode are examples of a "holding condition" according to aspects of the present disclosure. The type of the sheet P corresponding to (a) to (c) are examples of "specific materials" according to aspects of the present disclosure. The type of the sheet P not corresponding to (a) to (c) (i.e., the "specific materials") is an example of a "first condition" according to aspects of the present disclosure. The threshold value B is an example of a "first threshold value" according to aspects of the present disclosure. The threshold value A is an example of a "second threshold value" according to aspects of the present disclosure. The length of the sheet P in the conveying direction being less than the threshold value B (i.e., first threshold value) and the length of the sheet P being between the threshold values A (i.e., second threshold value) and B are examples of a "second condition" according to aspects of the present disclosure. The distance measuring sensor 97 and the controller 209 are examples of a "height acquiring part" according to aspects of the present disclosure.

What is claimed is:

1. An image forming apparatus, comprising:

a feed tray configured to accommodate a medium;

an image forming engine configured to form an image on the medium accommodated in the feed tray;

a discharge tray configured to receive the medium on which the image has been formed by the image forming engine;

a medium conveyer configured to convey the medium accommodated in the feed tray to the image forming engine along a conveying direction and conveying the medium on which the image has been formed by the image forming engine to the discharge tray;

a medium holder configured to hold the medium discharged to the discharge tray in a stopped conveying state and hanged from the discharge tray; and a controller configured to:

select a first discharge mode for causing the medium holder to continue to hold the medium discharged to the discharge tray when a holding condition is satisfied or a second discharge mode for causing the medium holder not to hold the medium discharged to the discharge tray or to hold the medium discharged to the discharge tray for a prescribed period and then release the medium; and control operations of the image forming engine, the medium conveyer and the medium holder based on the selected discharge mode, wherein the holding condition includes at least one of a first condition being that material of the medium does not correspond to specific material and a second condition being that a medium length of the medium in the conveying direction is less than a first threshold value.

2. The image forming apparatus according to claim 1, wherein the second condition further includes being that the medium length is greater than a second threshold value smaller than the first threshold value.

3. The image forming apparatus according to claim 1, wherein the holding condition includes the first condition, wherein the second discharge mode is a mode in which the controller causes the medium holder to hold and then release the medium discharged to the discharge tray, and wherein the controller changes a length of a time period in which to cause the medium holder to hold the medium in the second discharge mode according to material of the medium.

4. The image forming apparatus according to claim 1, wherein the holding condition includes the second condition, and wherein the first threshold value is configured to be set by a user.

5. The image forming apparatus according to claim 1, further comprising:

a height acquiring part configured to acquire a height of the discharge tray from a floor surface; and a threshold value setting part configured to set the first threshold value so that the higher the height acquired by the height acquiring part is, the greater the first threshold value becomes.

6. An image forming apparatus, comprising:

a feed tray configured to accommodate a medium;

an image forming engine configured to form an image on the medium accommodated in the feed tray;

a discharge tray configured to receive the medium on which the image has been formed by the image forming engine;

a medium conveyer configured to convey the medium accommodated in the feed tray to the image forming engine along a conveying direction and conveying the medium on which the image has been formed by the image forming engine to the discharge tray;

a medium holder configured to hold the medium discharged to the discharge tray in a stopped conveying state and hanged from the discharge tray; and a controller configured to:

cause the medium holder to continue to hold the medium discharged to the discharge tray when a medium length of the medium in the conveying direction is less than a first threshold value; and cause the medium holder not to hold the medium discharged to the discharge tray when a medium length of the medium in the conveying direction is equal to or greater than the first threshold value.

7. The image forming apparatus according to claim 6, wherein when the medium length is equal to or greater than the first threshold value and the medium is made of material of which tendency to become curled is low, the controller causes the medium holder to at least temporarily hold the medium discharged to the discharge tray.

8. The image forming apparatus according to claim 1, wherein when the medium length is equal to or greater than the first threshold value and the medium is made of material of which tendency to become curled is low, the controller controls the medium holder such that the lower the tendency to become curled is, the longer a time period in which to hold the medium discharged to the discharge tray becomes.

9. The image forming apparatus according to claim 6, wherein the first threshold value is set based on a height of the discharge tray from a floor surface.

10. The image forming apparatus according to claim 9, wherein the first threshold value is set by a user.

11. The image forming apparatus according to claim 9, further comprising:

a height acquiring part configured to acquire a height of the discharge tray from a floor surface; and a threshold value setting part configured to set the first threshold value so that the higher the height acquired by the height acquiring part is, the greater the first threshold value becomes.

12. The image forming apparatus according to claim 6, wherein when the medium length is less than a second threshold value that is smaller than the first threshold value, the controller causes the medium holder not to hold the medium discharged to the discharge tray.

13. The image forming apparatus according to claim 12, wherein the second threshold value is a maximum value of the medium length with which the medium discharged to the discharge tray does not fall off the discharge tray even when the medium is not held by the medium holder.

14. The image forming apparatus according to claim 1, a height acquiring part configured to acquire a height of the discharge tray from a floor surface; and a threshold value setting part configured to set the first threshold value so that the higher the height acquired by the height acquiring part is, the greater the first threshold value becomes.

* * * * *